US006318590B1

(12) United States Patent
McMurray-Stivers

(10) Patent No.: US 6,318,590 B1
(45) Date of Patent: Nov. 20, 2001

(54) TRAVEL TISSUE HOLDER

(76) Inventor: Lisa McMurray-Stivers, 1419 Marsh Rd., Eureka, CA (US) 95501

( * ) Notice: Subject to any disclaimer, the term of this patent is extended or adjusted under 35 U.S.C. 154(b) by 0 days.

(21) Appl. No.: 09/568,488

(22) Filed: May 10, 2000

Related U.S. Application Data

(60) Provisional application No. 60/133,812, filed on May 11, 1999.

(51) Int. Cl.[7] ..... A47K 10/24; B65H 1/00

(52) U.S. Cl. ..... 221/45; 221/281; 224/400; 224/440

(58) Field of Search ..... 221/45, 281; 224/400, 224/440

(56) References Cited

U.S. PATENT DOCUMENTS

| | | | | |
|---|---|---|---|---|
| 4,017,002 | | 4/1977 | Doyle . | |
| 4,180,160 | | 12/1979 | Ogawa et al. . | |
| 4,181,218 | | 1/1980 | Cox . | |
| 4,219,129 | | 8/1980 | Sedgwick . | |
| 4,244,493 | | 1/1981 | Harrison . | |
| 4,328,907 | | 5/1982 | Beard . | |
| 5,040,709 | * | 8/1991 | Neugent | 224/440 X |
| 5,158,180 | | 10/1992 | Zucker . | |
| 5,228,632 | | 7/1993 | Addison et al. . | |
| 5,467,893 | | 11/1995 | Landis, II et al. . | |
| 5,560,514 | | 10/1996 | Frazier . | |
| 5,577,634 | | 11/1996 | Morand . | |
| 5,718,353 | | 2/1998 | Kanfer et al. . | |
| 5,944,219 | * | 8/1999 | Emoff et al. | 221/45 X |
| 6,053,356 | * | 4/2000 | Emoff et al. | 221/45 X |
| 6,158,614 | * | 12/2000 | Haines et al. | 221/63 X |

FOREIGN PATENT DOCUMENTS

| | | |
|---|---|---|
| 0 006 709 A1 | 1/1980 | (EP) . |
| 0 818 400 | 1/1998 | (EP) . |
| 4-87967 | 3/1992 | (JP) . |

* cited by examiner

*Primary Examiner*—Christopher P. Ellis
*Assistant Examiner*—Gene O. Crawford
(74) *Attorney, Agent, or Firm*—Richard C. Litman

(57) ABSTRACT

A travel facial tissue holder/dispenser is disclosed which is adapted for use with cup holders typically found in vehicles. The dispenser comprises a substantially cylindrical hollow container and a plurality of dry facial tissue paper. The container has a sidewall body, a closed bottom portion attached to one end of the sidewall body and an apertured top portion attached to the opposite end. The sidewall body also has a retention means to aid in retaining the dispenser within the cup holder. The apertured top portion comprises a lid attached to the sidewall rim, and a tissue dispensing flap or panel attached to the lid and/or sidewall rim. The plurality of facial tissues are stored within the container such that the tissues can be continuously and individually retrieved through the tissue dispensing flap.

16 Claims, 5 Drawing Sheets

TRAVEL TISSUE HOLDER

CROSS-REFERENCE TO RELATED APPLICATION

This application claims the benefit of U.S. Provisional Patent Application Serial No. 60/133,812, filed May 11, 1999.

BACKGROUND OF THE INVENTION

1. Field of the Invention

The present invention relates generally to a travel tissue holder, and more particularly, to a travel tissue holder/dispenser adapted for use with a cup holder storage assembly commonly found in many vehicles.

2. Description of Related Art

Dry facial tissues such as those typically sold under the brand name KLEENEX and referred to herein as "facial tissues", as distinguished from wet tissues or wipes also known as towelettes, are often needed for a variety of reasons and purposes while traveling in a car, truck, minivan and the like. In order for consumers to have access to dry tissues while driving in a vehicle, consumers must typically purchase a large cumbersome box or other similarly shaped and sized dispenser. Such tissue boxes are designed for placement on flat stationary surfaces such as counter tops and tables, and are not properly designed for safe, convenient, and readily accessible use in most moving vehicles.

Typically, these cumbersome tissue boxes slide along the seat or dashboard, and usually end up either rolling on the floor behind the driver's seat, or on the floor in the front interior passenger compartment. A potentially dangerous scenario can occur when such tissue boxes end up on the driver's side floor, thereby potentially interfering with the driver's ability to safely handle the vehicle. Since bulky and cumbersome tissue boxes are not easily stored and readily accessible to drivers in most cars, vans or trucks, any location where they are kept can be a potentially dangerous or hazardous situation.

An alternative to the currently available tissue boxes are the small plastic "travel or pocket size" tissue dispensers/holders. Such travel size tissue dispensers typically contain too few tissues that are also usually too small in size. Even "travel size" tissue holders can be inaccessible when they are stuffed in a hard to reach pocket, purse, glove box, stuck between seats or seat cushions, or located in other difficult to reach positions such as beneath or behind a car seat. Furthermore, "travel size" tissue dispensers can also suffer from the same disadvantages of the larger more cumbersome boxes, such as sliding around the interior passenger compartment of the vehicle.

Hence, there is presently a strong felt need for a travel facial (dry) tissue dispenser/holder for use in vehicles that provides a sufficient quantity of full-sized dry facial tissues in a safe, and conveniently located position within the vehicle. The current invention addresses this long felt need by providing a tissue dispenser specifically adapted for placement and storage within cup holder assemblies found in most vehicles.

Cup holder assemblies, also simply referred to herein as cup holders, are commonplace in most vehicles currently available. The majority of these vehicles have more than one cup holder. Cup holders are located throughout the interior passenger compartment of the vehicle for the benefit of not only the driver, but usually each and every passenger. In fact, cup holders are typically found on one or more door panels, along the dashboard, in center consoles, on arm rests, etc., as well as various combinations of these locations.

The following patents teach various kinds of dispensers, usually for pre-moistened towelettes, and the like:

U.S. Pat. No. 4,017,002 issued on Apr. 12, 1977 to Doyle et al., shows a substantially airtight container for dispensing a perforated wet impregnated tissue like material;

U.S. Pat. No. 4,181,218 issued on Jan. 1, 1980 to Cox, shows a pre-moistened tissue dispensing container having a molded base and a removable cap;

U.S. Pat. No. 4,219,129 issued on Aug. 26, 1980 to Sedgwick, shows a moist tissue dispenser in which a constricted orifice seals the container and provides drag so that each moist tissue is separated from the roll in turn;

U.S. Pat. No. 4,244,493 issued on Jan. 13, 1981 to Harrison shows a dispensing device for pre-moistened towelettes in which the roll is surrounded by a bag, and the towelettes are pulled out of the top of the bag;

U.S. Pat. No. 4,328,907 issued on May 11, 1982 to Beard, shows a dispensing container with a removable cap for dispensing a linked succession of pre-moistened non-woven fabric wipes;

U.S. Pat. No. 5,158,180 issued on Oct. 27, 1992 to Zucker, shows a closable dispenser of wet tissues wherein the tissue edge is protected from drying out when not in use;

U.S. Pat. No. 5,228,632 to Addison et al., shows a dispenser for rolled towel and tissue which includes two separable interfitting elements;

U.S. Pat. No. 5,467,893 issued on Nov. 21, 1995 to Landis, II et al., shows a storage and dispensing canister for pre-moistened towelettes having a container and a multi-functional cap.

U.S. Pat. No. 5,560,514 issued on Oct. 1, 1996 to Frazier, shows a centerflow dispenser for dispensing saturated wipers which has a nozzle with a rotatable dispensing disk;

U.S. Pat. No. 5,577,634 issued on Nov. 26, 1996 to Morand, shows a dispenser for perforated rolls of paper towelling, which has an opening in the base through which one end of the towelling is passed in the form of a spiral tail;

U.S. Pat. No. 5,718,353 issued on Feb. 17, 1998 to Kanfer et al., shows a closure assembly for towelette dispensing, having a flange and antirotation tabs;

European Patent Application 0 006 709 to Unilever N.V. shows a closure for a moist tissue dispenser having two superimposed diaphragms with openings completely out of register with the other; and Japanese Patent Document 4-87967, included for its drawings, shows a towelette dispenser having an apertured top.

However, each of these patents fail to teach a travel facial tissue dispenser/holder adapted for use in cup holders commonly found in most cars, trucks and minivans.

None of the above inventions and patents, taken either singly or in combination, is seen to describe the instant invention as claimed. Moreover, none of the above inventions and patents recognizes the problems associated with the storage and dispensing of facial tissues within a safe, convenient, and easy to reach location for vehicular occupants. None of the above inventions and patents show a tissue dispenser specifically designed to fit snugly and securely within the confines of a cup holder commonly found in most vehicles such as cars, minivans and trucks.

SUMMARY OF THE INVENTION

A travel tissue dispenser is disclosed for use with a vehicular cup holder. The dispenser includes a substantially cylindrical hollow container having a sidewall body, a closed bottom portion, and an apertured top portion. The apertured top portion includes a lid and a tissue dispensing flap. The dispenser also has a plurality of dry facial tissues located within the container. A retention device, such as a set of projections or a retaining rim, retains the container in the vehicular cup holder when the facial tissues are dispensed through the aperture of the tissue dispensing flap.

Accordingly, it is a principal object of the invention to provide a travel facial tissue dispenser comprising a substantially cylindrical hollow container and a plurality of facial tissues.

It is another object of the invention to provide a travel facial tissue dispenser adapted for use in a cup holder located in a vehicle.

It is a further object of the invention to provide a travel facial tissue dispenser that stays securely in a cup holder when stored therein, thereby preventing the dispenser from moving about the interior passenger compartment.

Still another object of the invention is to provide a travel facial tissue dispenser that is disposable, convenient to use and easily accessible when placed in cup holders located throughout the interior passenger compartment of a vehicle.

It is an object of the invention to provide improved elements and arrangements thereof in a travel tissue dispensing apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
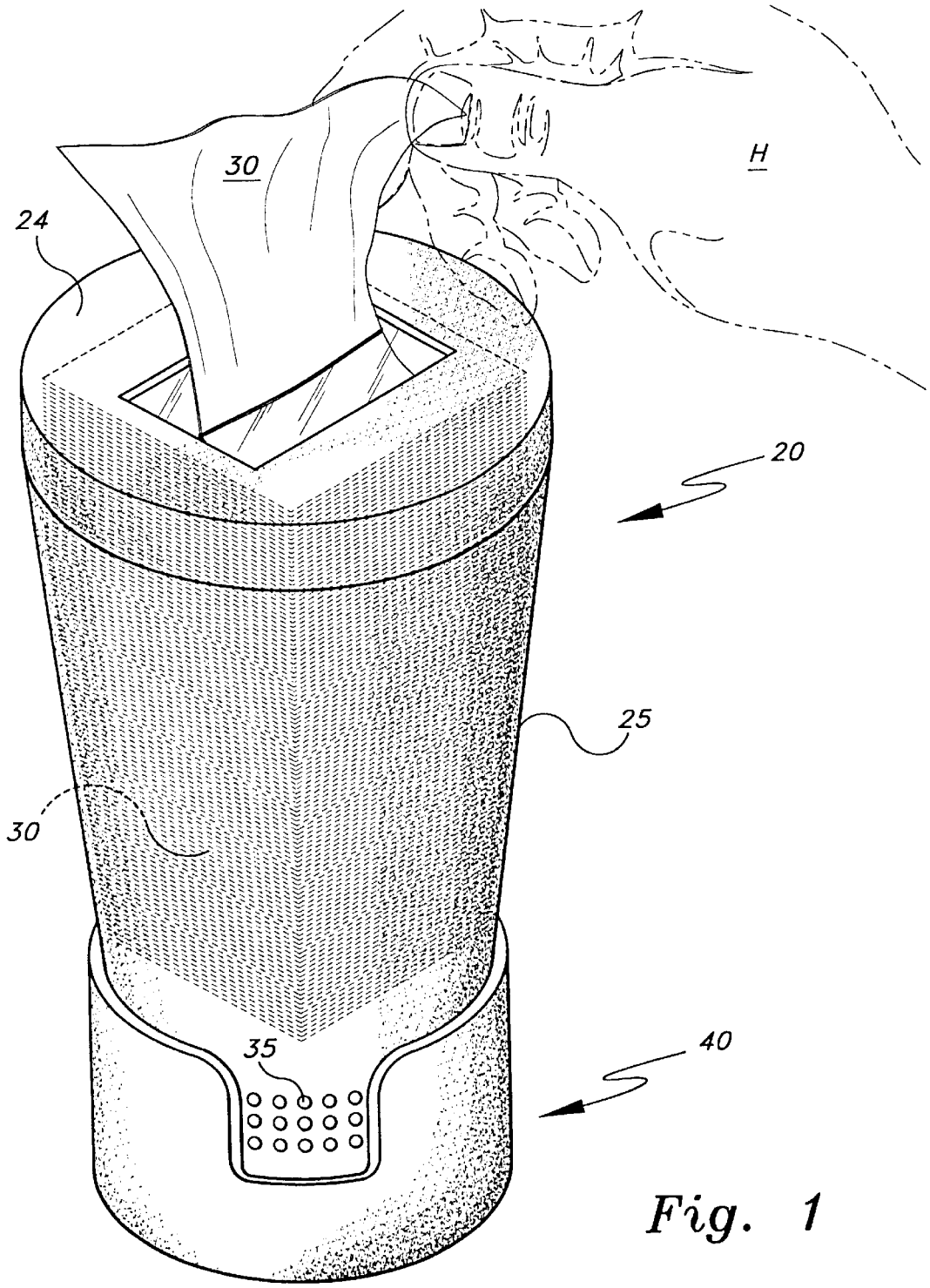
FIG. 1 is an environmental, perspective view of a travel facial tissue holder/dispenser according to the present invention contained within a cup holder assembly.

As depicted in FIGS. 1–4, the present invention pertains to a travel tissue dispenser/holder 20 for use with a vehicular cup holder 40. FIG. 1 depicts an environmental perspective view of the travel facial tissue holder/dispenser 20 (also referred to herein as simply dispenser) contained within a cup holder assembly 40. The cup holder assembly may have a variety of configurations, as shown in FIGS. 1–6. The travel tissue dispenser/holder 20 comprises a substantially cylindrical hollow container 22, and a plurality of facial tissues 30 contained therein.

The container has a circular or substantially circular cross-section, as shown in FIGS. 1–4. The container 22 is preferably slightly tapered towards the bottom, and may have the shape of an inverted, truncated cone with a slight taper. For example, the taper may be from a top diameter of 3½ inches (9 cm) to a bottom diameter of 2½ inches (6 cm). The substantially cylindrical hollow container 22 has a sidewall body 25, a closed bottom portion 28 attached to one end of the sidewall 25, and an apertured top portion 24 attached to the opposite end of the sidewall 25. The sidewall body 25 also has an inner surface 37 and an outer surface 41. See FIG. 5.

The travel tissue dispenser/holder 20 includes a retention means for enhancing the ability of the dispenser 20 to stay within the cup holder assembly 40. The retention means may be a series of projections 35, or a raised retaining rim or ridge 31, or a variety of other retention means.

The plurality of facial tissues 30 can be stored within the container 22 in various orientations (e.g., stacked, wound, rolled, etc.) and in varying quantities, so long as the tissues 30 are positioned within the dispenser 20 such that a user can easily retrieve each tissue individually and in a continuous fashion through the apertured top portion 24.

FIG. 1 also depicts a hand H, shown in phantom, removing a dry facial tissue 30 from the travel tissue dispenser 20. FIG. 1 also depicts a plurality of stacked tissues 30, shown in phantom, contained within the dispenser 20.

Figure 2:
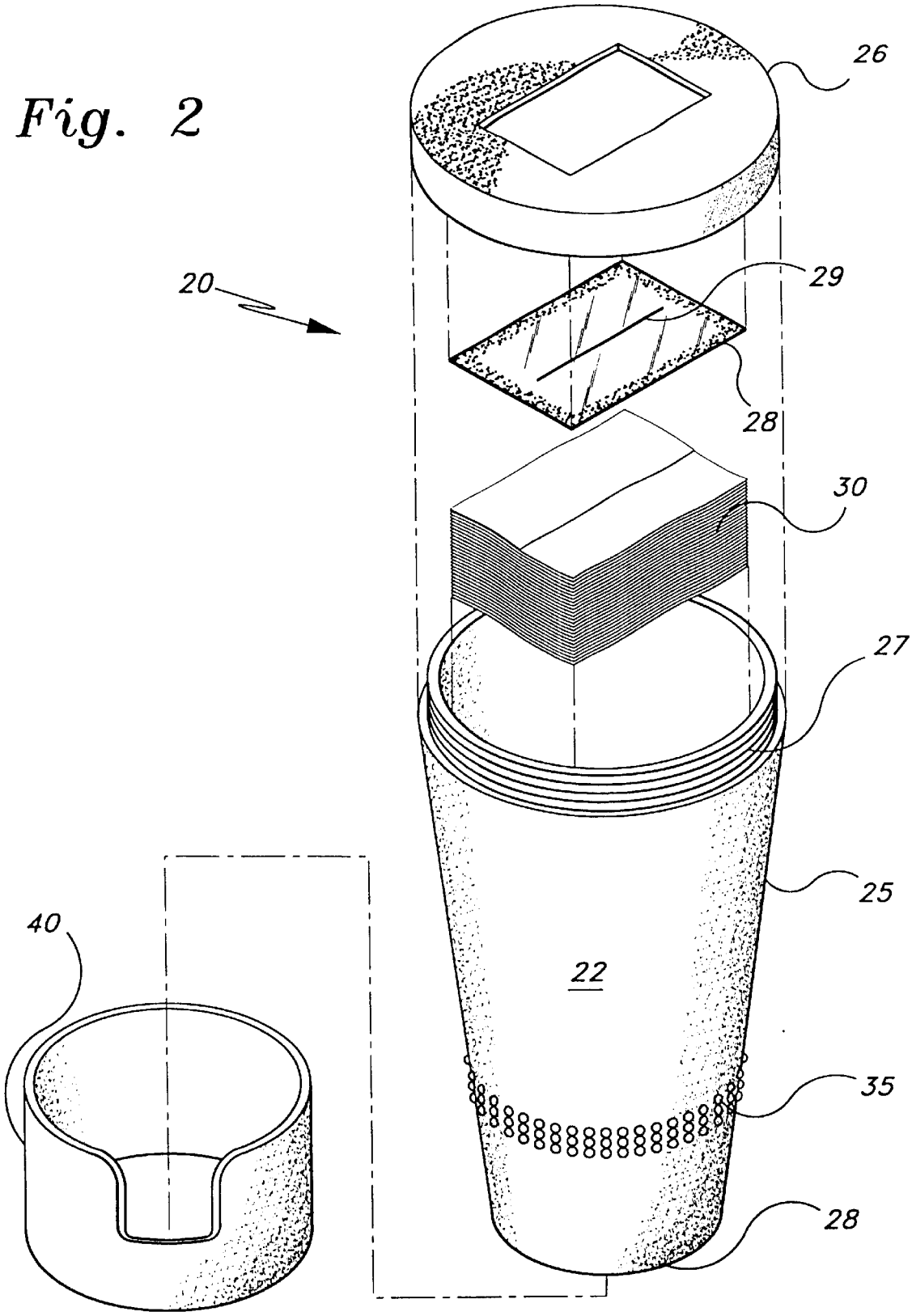
FIG. 2 is an exploded view of the travel facial tissue holder/dispenser and cup holder assembly shown in FIG. 1.

As depicted in an exploded view of FIG. 2, the apertured top portion 24 includes an apertured lid 26 attached to the container 22 by attachment means. The apertured lid 26 may be fixedly attached, as by an adhesive. The apertured lid 26 may be removably attached, as by threads 27 (only shown on the sidewall 25). The apertured lid may also attach by snap fitting.

The apertured top portion 24 includes an apertured tissue dispensing flap(s) or panel 28 with a slit 29. The apertured tissue dispensing flap 28 shown in FIGS. 1–2 has a single slit 29 and is a preferred embodiment. It should be realized however, that the apertured tissue dispensing flap 28 can have slit(s) or opening(s) of varying shapes and sizes. The apertured tissue dispensing flap 28 is preferably made of a transparent flexible shape retaining plastic material fixedly attached by attachment means, such as glue, adhesive and the like, to the bottom portion of the lid 26. When the apertured tissue dispensing flap or panel 28 is transparent, it also acts as a window to enable the user to determine approximately how many tissues 30 remain in the dispenser/holder 20.

The outer surface of the container 22 may be smooth throughout. Alternatively, the container may have projections 35 attached to the outer circumference of the sidewall 25 of the container 22. See FIG. 2. The projections are preferably located near the region of the container 22 that comes in contact with the cup holder assembly 40. The projections 35 shown in this embodiment preferably have a non-slip surface. The non-slip surface can include raised rubber or plastic studs, nubs, tiny finger-like appendages and the like. The projections 35 provide a temporary anchoring effect to the dispenser 20 when the dispenser is positioned in the cup holder 40.

Removing a tissue from the dispenser causes an upward force on the container. Since dry tissues are lightweight, this upward force can remove the dispenser from the cup holder if it is not counteracted. The retention means enhances the ability of the dispenser 20 to remain within the cup holder 40 when a tissue 30 is removed. The retention means may be as simple as weighting the bottom portion 28 or the entire container 22, as long as the added weight is sufficient to counteract the upward force of tissue removal. The shape of the container 22 may also act as a retention means, as it corresponds to that of the cup holder 40; removal is resisted by the snug fit in the cup holder. More than one retention means may be used, such as a small weighting combined with snug fit. The cup holder itself may additionally include a retention means for resisting removal of the container.

However, the retention means is preferably located on the outer surface of the sidewall. The retention means can be located over a wide range of surface area on the outer surface of the sidewall 25 of the container 22, so long as the ability of the dispenser 20 to remain securely within the confines of the cup holder assembly 40 is improved or enhanced.

The retention means can be a single strip or layer 32, or a series of strips (not shown) of non-slip material such as rubber or plastic coated or applied to the outer surface of the sidewall 25 of the container 22. See FIG. 5. The non-slip material may be PVC. The retention means is preferably located near that region of the container 22 that comes in contact with the cup holder assembly 40. The retention means can be selected from a variety of materials and can have a variety of shapes and sizes so long as the retention means retains the function of enhancing the ability of the dispenser 20 to remain within the confines of the cup holder.

Figure 3:
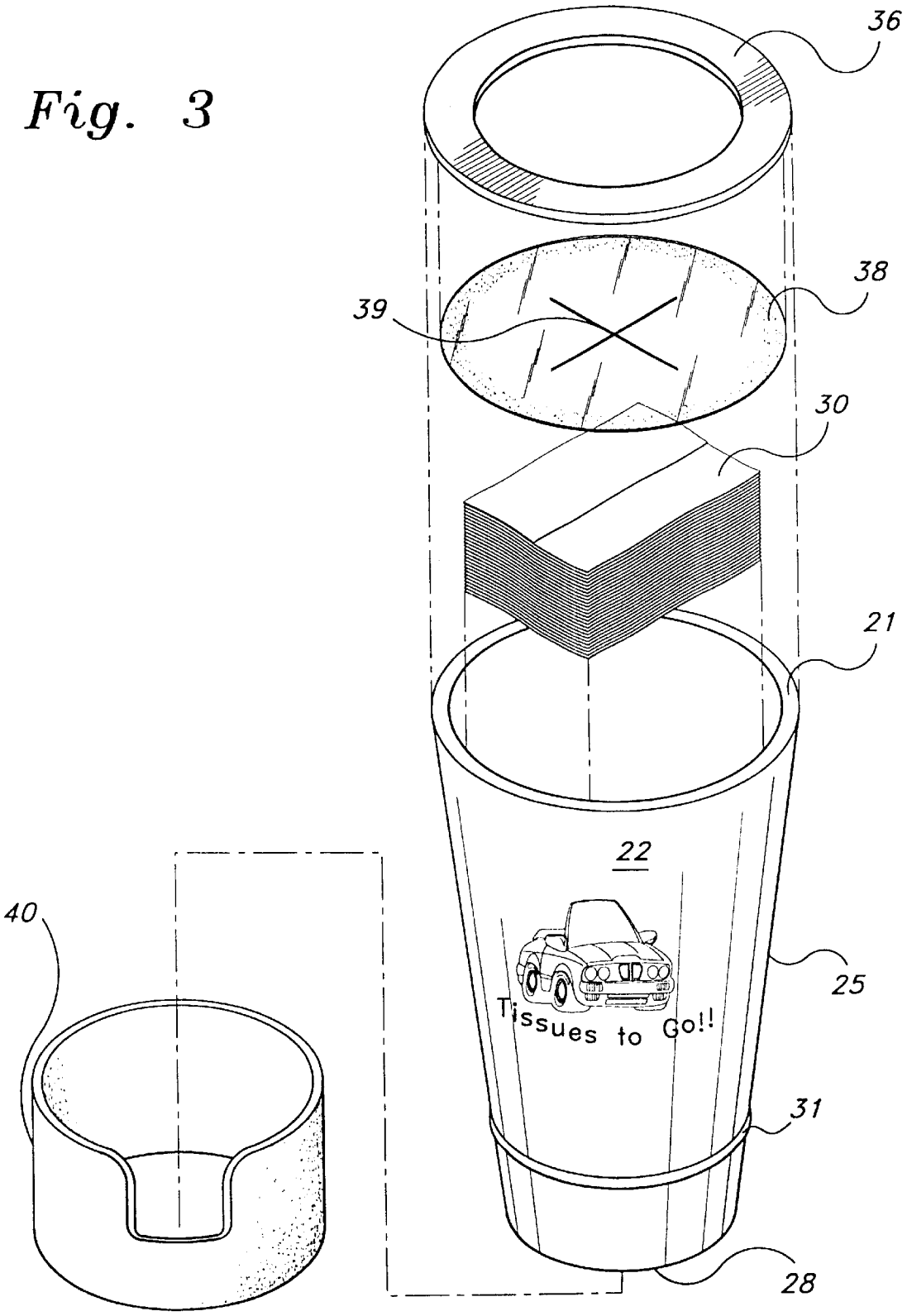
FIG. 3 is an exploded view of an alternative embodiment of the travel facial tissue holder/dispenser according to the present invention contained within a cup holder assembly.

FIG. 3 depicts an exploded view an alternative embodiment of the travel tissue dispenser 20, wherein the sidewall 25 has an outer surface with decorative indicia thereon. In the alternative embodiment depicted in FIG. 3, the apertured top portion 34 (shown in FIG. 4) comprises an apertured lid 36 having a circular opening fixedly attached by attachment means such as glue, adhesive or the like, to the upper rim portion 21 of the sidewall body 25. A circular apertured tissue dispensing flap or panel 38 with a cross-slit 39, preferably made of a transparent flexible shape retaining plastic material, is fixedly attached by attachment means, such as glue, adhesive and the like, to the bottom portion of the lid 36 and/or to the upper rim portion 21 of the sidewall body 25. The apertured tissue dispensing flap 28 shown in FIGS. 3–4 as having a cross-slit 39 is only a preferred embodiment. It should be realized however, the apertured tissue dispensing flap 38 can have slit(s) or opening(s) of varying shapes and sizes.

Figure 4:
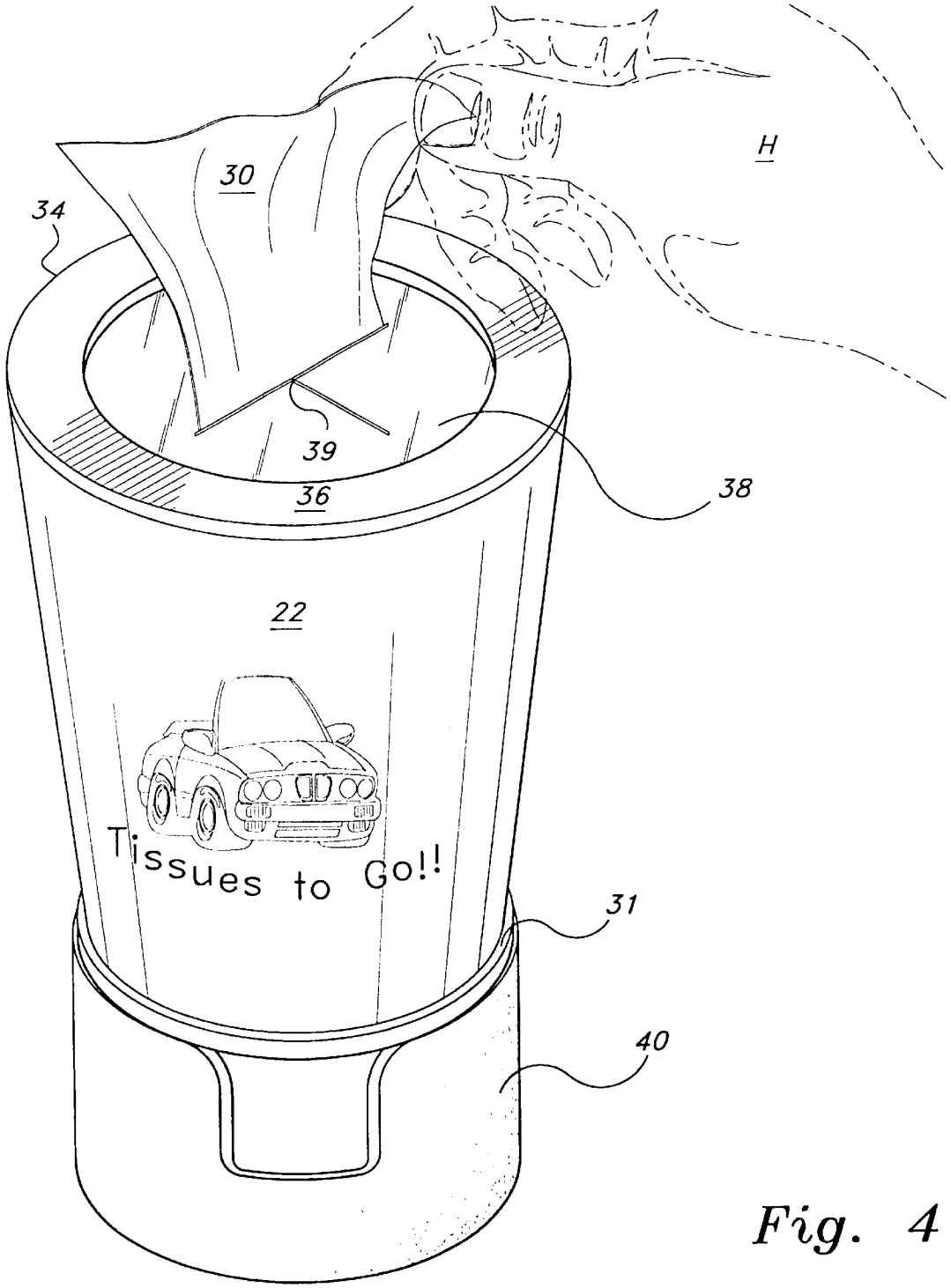
FIG. 4 is an environmental, perspective view of the travel facial tissue holder/dispenser and cup holder assembly shown in FIG. 3.
Figure 5:
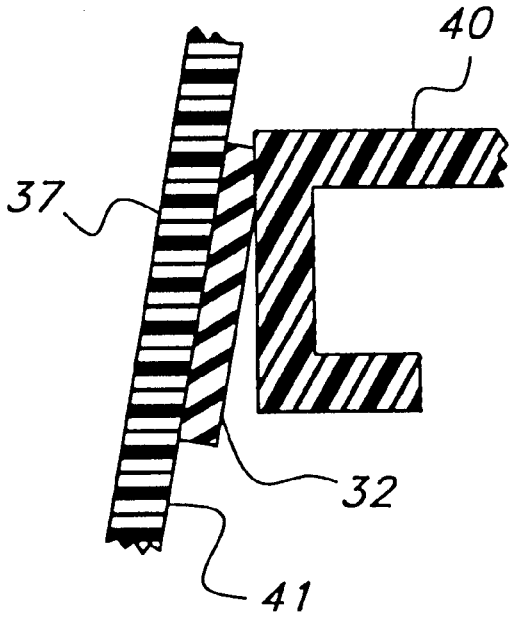
FIG. 5 is a cross-sectional, detail view of a container in a cupholder having a strip of non-slip material.
Figure 6:
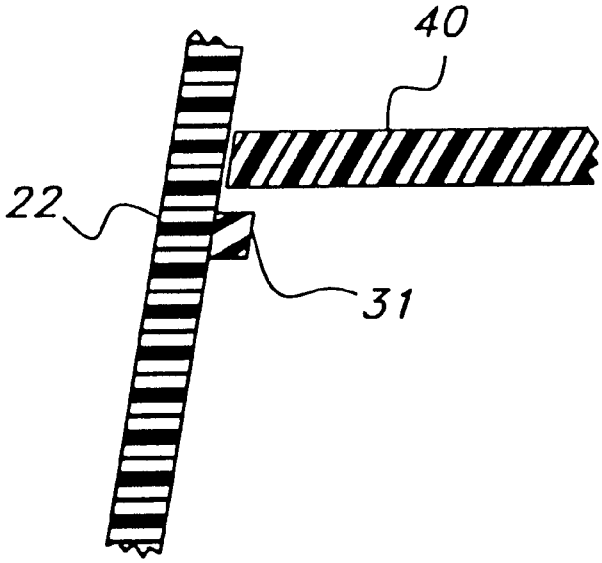
FIG. 6 is a cross-sectional, detail view of a container in a cupholder having a retaining rim of non-slip material.

FIG. 4 depicts an environmental perspective view of the travel facial tissue dispenser 20, having a retaining rim 31, and cup holder assembly 40 shown in FIG. 3. The retention means is preferably a raised retaining rim, ridge, or lip attached to the outer circumference of the sidewall 25 of the container 22. See FIG. 6. The retaining rim is preferably located near the region of the container 22 that comes in contact with the cup holder assembly 40 when the dispenser/holder is seated therein. Two or more retaining rims may be included at different points on the container, to fit cup holders of varying diameters.

The raised retaining rim 31 is preferably made of a flexible shape retaining material such as rubber, plastic or cardboard that enables the retaining rim 31 to grip or hold onto the cup holder 40 by encompassing the top portion of the cup holder 40, thereby forming a temporary attachment. A plastic foam may also be used. The retaining rim may be formed of the same material as the container, or of a different material. The retaining rim 31 is preferably sufficiently compressible so that the top portion of the cup holder 40 is permitted to slide partially or completely over the retaining rim 31 when pushed into the cup holder. The top portion of the cup holder 40 is retained between the sidewall 25 of the container 22 and the retaining rim 31. See FIG. 6. This arrangement resists the small upward force of a tissue being removed from the container. A stronger force, such as a hand pulling upward on the container itself, will easily remove the dispenser from the cup holder when desired.

In the preferred embodiment, the travel tissue dispenser/holder 20 has a substantially cylindrical shape, slightly tapered towards the bottom portion. The shape is adapted to snugly and securely fit the majority of cup holders found in most cars, trucks and minivans. The travel tissue dispenser/holder can come in various sizes and shapes not shown, so long as it is adapted to properly and securely fit within the confines of a cup holder.

The travel tissue dispenser/holder 20 can be made from a variety of materials such as paper, plastic or a combination of both. The dispenser/holder 20 can also be transparent, translucent or decorated in any variety of colors, patterns, indicia, etc. In a preferred embodiment, the dispenser 20 is disposable and biodegradable, and sold as a set of four dispensers. The dry facial tissues dispensed from the invention are preferably pre-folded interfolded tissue paper, such as those typically found in facial tissue boxes known in the art, in order to allow for the continuous removal of one tissue after another.

It is to be understood that the present invention is not limited to the sole embodiments described above, but encompasses any and all embodiments within the scope of the following claims.

I claim:

1. A travel tissue dispenser in combination with dry facial tissues for use with a vehicular cup holder comprising:

(a) a substantially cylindrical hollow container having a sidewall body, a closed bottom portion attached to one end of the sidewall body, and an apertured top portion attached to the opposite end of the sidewall body; wherein the sidewall body has an inner surface and an outer surface;

the apertured top portion includes a lid and a tissue dispensing flap, the lid is attached to the sidewall body, and the tissue dispensing flap has an aperture;

(b) a plurality of facial tissues located within the container, the facial tissues being dry; wherein the facial tissues, the container, and the apertured top portion are adapted to individual and continuous dispensing of the facial tissues through the aperture of the tissue dispensing flap; and (c) a plurality of projections located on the outer surface of the sidewall body for retaining the container in the vehicular cup holder when the facial tissues are dispensed through the aperture of the tissue dispensing flap, each of said projections is selected from the group consisting of studs, ribs, and finger-like appendages.

2. The dispenser according to claim 1, wherein:

the container is tapered towards the bottom portion.

3. The dispenser according to claim 1, wherein:

the container has the shape of an inverted, truncated cone.

4. The dispenser according to claim 1, wherein:

the apertured tissue dispensing flap is made of a flexible transparent shape retaining plastic material.

5. The dispenser according to claim 1, wherein:

the outer surface of the sidewall body contains indicia located thereon.

6. The dispenser according to claim 1, wherein the lid is fixedly attached to the sidewall body.

7. The dispenser according to claim 1, wherein the lid is removably attached to the sidewall body.

8. The dispenser according to claim 1, wherein the facial tissues are composed of pre-folded interfolded tissue paper.

9. The dispenser according to claim 1, further comprising, in combination, a vehicular cup holder.

10. A travel tissue dispenser in combination with dry facial tissues for use with a vehicular cup holder comprising:

(a) a substantially cylindrical hollow container having a sidewall body, a closed bottom portion attached to one end of the sidewall body, and an apertured top portion attached to the opposite end of the sidewall body; wherein the sidewall body has an inner surface and an outer surface;

the apertured top portion includes a lid and a tissue dispensing flap, the lid is attached to the sidewall body, and the tissue dispensing flap has an aperture;

(b) a plurality of facial tissues located within the container, the facial tissues being dry; wherein the facial tissues, the container, and the apertured top portion are adapted to individual and continuous dispensing of the facial tissues through the aperture of the tissue dispensing flap; and (c) a strip of non-slip material located on the outer surface of the sidewall body for retaining the container in the vehicular cup holder when the facial tissues are dispensed through the aperture of the tissue dispensing flap.

11. The dispenser according to claim 10, wherein:

the container is tapered towards the bottom portion.

12. The dispenser according to claim 10, wherein:

the apertured tissue dispensing flap is made of a flexible transparent shape retaining plastic material.

13. The dispenser according to claim 10, wherein the lid is fixedly attached to the sidewall body.

14. The dispenser according to claim 10, wherein the lid is removably attached to the sidewall body.

15. The dispenser according to claim 10, wherein the facial tissues are composed of pre-folded interfolded tissue paper.

16. The dispenser according to claim 10, further comprising, in combination, a vehicular cup holder.

* * * * *